United States Patent [19]

Bartels et al.

[11] 4,399,890

[45] Aug. 23, 1983

[54] INDEPENDENTLY MOUNTED FALL PREVENTION APPARATUS

[75] Inventors: Leroy R. Bartels, Hager City, Wis.; John H. Lawson, Red Wing, Minn.; Paul L. King, Stockholm, Wis.

[73] Assignee: International Telephone and Telegraph Corporation, New York, N.Y.

[21] Appl. No.: 265,407

[22] Filed: May 20, 1981

[51] Int. Cl.[3] ..... A62B 1/20

[52] U.S. Cl. ..... 182/100; 182/8; 182/190

[58] Field of Search ..... 182/5, 6, 7, 8, 100, 182/190; 52/148, 149; 405/288, 259

[56] References Cited

U.S. PATENT DOCUMENTS

| | | | |
|---|---|---|---|
| 1,828,349 | 10/1931 | Williams | 52/149 |
| 2,128,030 | 8/1938 | Koleno | 52/148 |
| 3,245,649 | 4/1966 | Cassidy | 52/148 |
| 3,598,200 | 8/1971 | Thompson | 182/8 |
| 3,908,791 | 9/1975 | Kleine | 182/8 |

FOREIGN PATENT DOCUMENTS

| | | | |
|---|---|---|---|
| 1425172 | 12/1965 | France | 182/5 |

*Primary Examiner*—Reinaldo P. Machado

*Attorney, Agent, or Firm*—James B. Raden; Donald J. Lenkszus

[57] ABSTRACT

A flexible cable safety system for a fixed ladder is mounted adjacent to and independent of the ladder. This arrangement is useful for ladders which are not designed to withstand the loads imposed when a safety system arrests the fall of a workman.

4 Claims, 4 Drawing Figures

INDEPENDENTLY MOUNTED FALL PREVENTION APPARATUS

BACKGROUND OF THE INVENTION

This invention pertains to apparatus intended to restrain a user from falling.

Safety clamps are well-known to the art. Flexible cable safety systems for fixed ladders have been in existence for a number of years. All such systems are mounted directly to the fixed ladder. However, in certain applications, the ladder may not be able to withstand the loads imposed in arresting a workman's fall. One prime example of such a ladder may be found in mines, such as uranium mines, wherein wooden ladders are utilized between adjacent mine levels or operating areas.

U.S. Pat. No. 3,908,791 illustrates in FIG. 1 a prior flexible cable safety system which is directly connected to a fixed ladder.

SUMMARY OF THE INVENTION

In accordance with the principles of the invention, a flexible cable safety system is mounted adjacent to and independent of a fixed ladder. This invention is particularly advantageously employed in conjunction with ladders which may not be capable of supporting the sudden and substantial loads exerted when a workman falls from the ladder and a safety device suddenly arrests the fall by gripping the cable.

In the illustrative embodiment of the invention, a tensioned flexible safety cable is mounted in proximity to a wooden ladder. Mounted is accomplished by utilizing a bracket which is attached to the upper end of the cable and in turn which is attached to a plate which is affixed to the roof of the mine by mounting pins. A second bracket is secured to the floor of the mine and carries a compression spring which engages a tie rod that in turn is clamped to the lower end of the safety cable.

BRIEF DESCRIPTION OF THE DRAWINGS

The invention may be better understood from a reading of the following detailed description in conjunction with the drawings in which like reference numerals designate like parts and in which.

DETAILED DESCRIPTION

Figure 1:
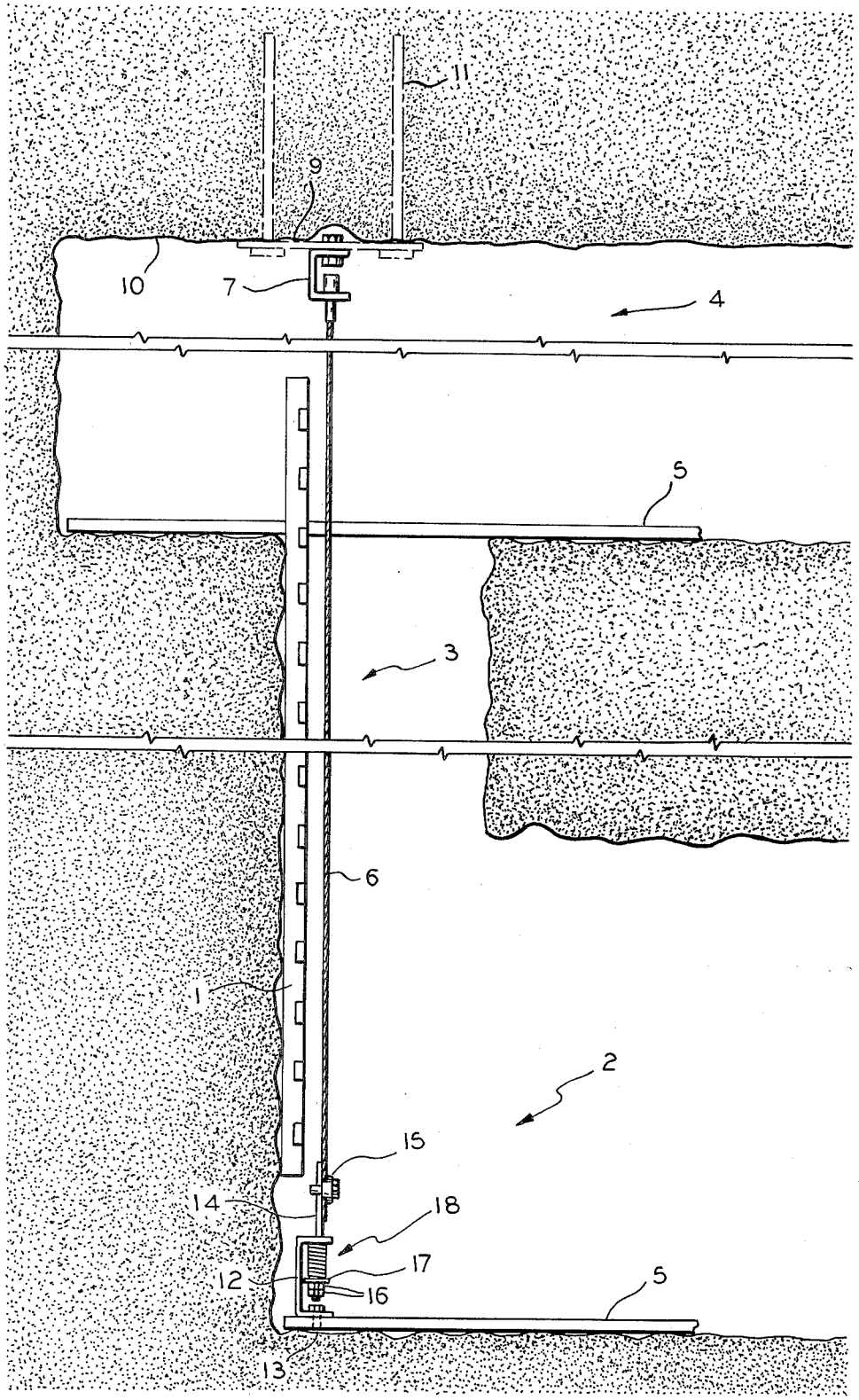
FIG. 1 illustrates a safety system in accordance with the principles of the invention.

In FIG. 1 a fixed position wooden ladder 1 extends from one level 2 of a mine through a shaft 3 to an upper level 4 of the mine. Typically the floors in both levels are covered with oak flooring planks 5. Spaced apart from the ladder 1 is a flexible steel safety cable 6. The upper end of the cable 6 is coupled to a roof bracket 7 by means of tube 8 which is swaged to the cable. The bracket is connected to a roof mounting plate 9 which in turn is affixed to the mine roof 10 by means of mounting pins 11.

The lower end of the cable is connected to the flooring planks by means of a mounting assembly that includes a floor bracket 12.

The lower end of the floor bracket 12 is secured to the flooring by means of lag screws 13. The upper end of the bracket is apertured and a tie rod 14 extends through the aperture. The upper portion of the tie rod 14 is connected to cable 6 by means of a rope clip and adjustment nuts assembly 15. The lower end of the rod 14 utilizes nuts 16 and washer 17 to capture a compression spring 18. The compression spring 18 acts to keep the cable 6 under tension.

Figure 2:
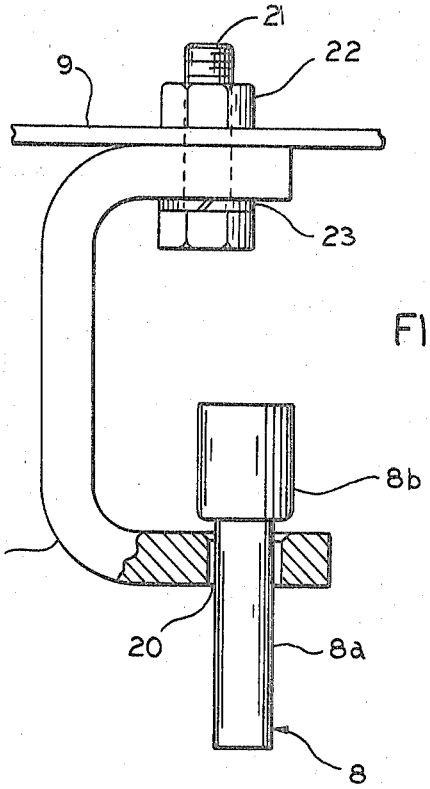
FIG. 2 illustrates the upper roof bracket of FIG. 1.

Turning to FIG. 2, the upper roof bracket 7 is "C" shaped. Tube 8 which extends through aperture 20 is shown displaced slightly upwards for clarity. Tube 8 is swaged to the cable 9 in its lower portion 8*a* and in its upper portion is rounded at 8*b* to permit swivel movement. The upper end of bracket 7 is apertured so that capscrew 21 may be passed therethrough to secure bracket 7 to plate 9 with nut 22 and lockwasher 23.

Figure 3A:
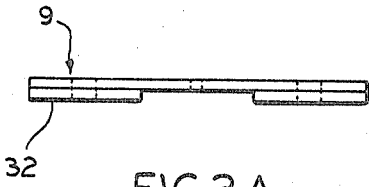
FIG. 3A and 3B illustrates the roof mounting plate of FIG. 1.
Figure 3B:
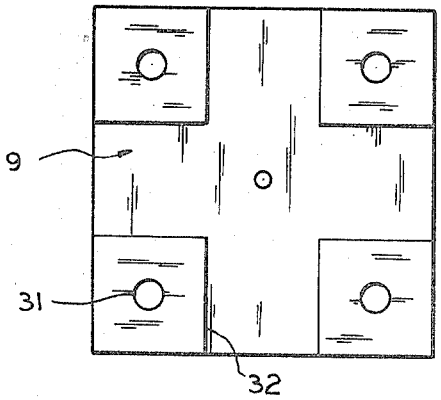

FIGS. 3A and 3B shown that the mounting plate 9 includes four corner holes 31 through which the roof mounting pins 11 are passed. A square washer 32 is provided on the bottom of plate 9 at each corner.

Figure 4:
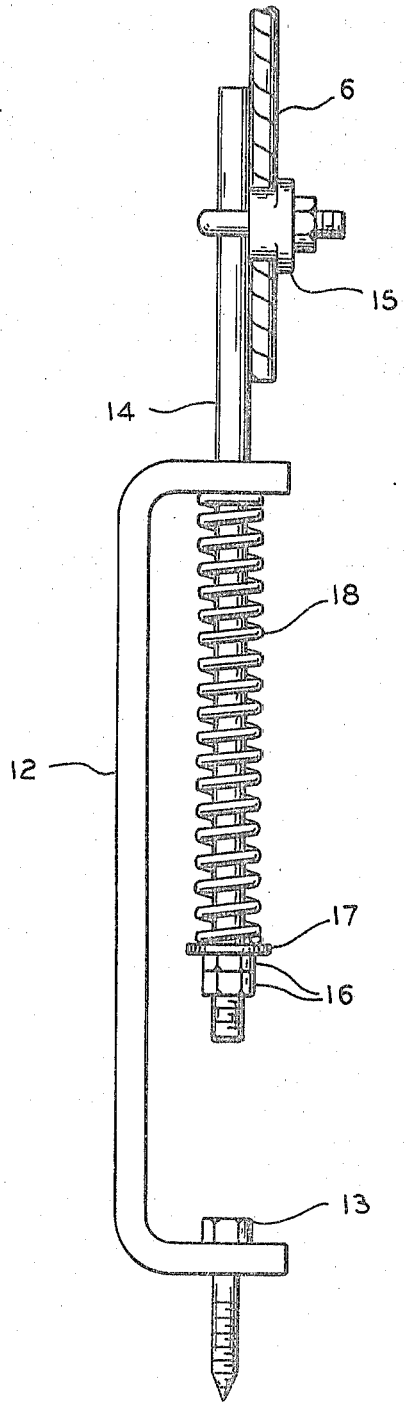
FIG. 4 illustrates the floor bracket assembly of FIG. 1.

FIG. 4 shows the floor bracket assembly in greater detail. The floor bracket 12 is in the shape of an elongated "C". The upper arm is apertured. Tie rod 14 which extends through the aperture carries the spring 18. Spring 18 acts against the bracket 12 and the washer 17 thereby urging rod 14 downward to maintain tension on the cable 16.

In use, prior to a workman ascending or descending the ladder shown in FIG. 1, he will connect a safety clamp which is carried on a safety belt which he is wearing to the cable 6. In the event that the workman should fall, the safety clamp will grip the cable 6 to arrest the fall. The sudden load exerted on the safety cable will be transferred to and absorbed by the mine roof.

What is claimed is:

1. Safety cable apparatus for use in a fall prevention system adapted for use with a fluid mounted ladder in a mine, said apparatus comprising:

a flexible safety cable;

a mounting plate, said mounting plate being adapted for fastening to the ceiling of said mine by means of mounting pins;

an upper mounting bracket having upper and lower arms and a web interconnecting said upper and lower arms, said upper arm being fixedly mounted to said mounting plate, said lower arm having an aperture;

a pin having a lower portion extending through said aperture and being swaged to said cable, said pin having an upper portion having a diameter greater than the diameter of said aperture, said upper portion being supported by said lower arm;

a lower mounting bracket coupled to the lower end of said cable and fixedly mounted to a floor below said ladder;

said upper and lower brackets being positioned such that said cable is supported in proximity to said ladder.

2. Safety cable apparatus in accordance with claim 1 comprising: means for maintaining said cable under tension.

3. Safety cable apparatus in accordance with claim 2, wherein said lower bracket comprises an aperture, and said apparatus comprises a tie rod extending through said aperture, a clip connecting the upper end of said tie rod to the lower end of said cable, retaining means on the lower end of said tie rod, and a compression spring between said lower bracket and said retaining means to maintain said cable under tension.

4. Safety cable apparatus in accordance with claim 3 wherein said lower bracket comprises upper and lower arms and a web interconnecting said upper and lower arms, said lower bracket upper arm comprising said lower bracket aperture, said lower bracket lower arm being mounted to said floor, said spring being retained between said retaining means and said lower bracket upper arm.

* * * * *